US005756270A

United States Patent [19]

Fyson

[11] Patent Number: 5,756,270

[45] Date of Patent: May 26, 1998

[54] METHOD OF PROCESSING A PHOTOGRAPHIC SILVER HALIDE COLOR MATERIAL

[75] Inventor: John Richard Fyson, Hackney, United Kingdom

[73] Assignee: Eastman Kodak Company, Rochester, N.Y.

[21] Appl. No.: 721,860

[22] Filed: Sep. 27, 1996

[30] Foreign Application Priority Data

Sep. 29, 1995 [GB] United Kingdom ..... 9519861

[51] Int. Cl.[6] ..... G03C 7/44

[52] U.S. Cl. ..... 430/398; 430/373; 430/399; 430/414; 430/427; 430/461; 430/943

[58] Field of Search ..... 430/357, 398, 430/427, 430, 432, 461, 943, 373, 399, 400, 414

[56] References Cited

U.S. PATENT DOCUMENTS

| | | | |
|---|---|---|---|
| 4,062,684 | 12/1977 | Hara et al. | 430/943 |
| 4,301,236 | 11/1981 | Idota et al. | 430/430 |
| 4,529,687 | 7/1985 | Hirai et al. | 430/373 |
| 5,324,624 | 6/1994 | Twist | 430/943 |
| 5,547,816 | 8/1996 | Fyson et al. | 430/430 |

FOREIGN PATENT DOCUMENTS

| | | |
|---|---|---|
| 620488 | 10/1994 | European Pat. Off. . |
| 91/17478 | 4/1990 | WIPO . |
| 91/17479 | 4/1990 | WIPO . |

*Primary Examiner*—Hoa Van Le
*Attorney, Agent, or Firm*—J. Lanny Tucker

[57] ABSTRACT

A method of processing an imagewise exposed photographic silver halide color material which comprises color development and bleach steps. Between these two steps is a fixing, stop or wash step, the solution for which is passed through an absorbent material that removes carryover color developing agent.

8 Claims, No Drawings

METHOD OF PROCESSING A PHOTOGRAPHIC SILVER HALIDE COLOR MATERIAL

FIELD OF THE INVENTION

This invention relates to the processing of color photographic materials and in particular those that are processed with an intermediate bath between the color development and bleaching steps. This intermediate bath might be a stop, wash or fixing solution. It is particularly useful when low replenishment rates are used in order to minimize the generation of effluent.

BACKGROUND OF THE INVENTION

There are many references to removal of developing agents by adsorbents in photographic systems to reduce wash water requirements.

Absorbents in stop baths are used in the processing of motion picture films to recover color developing agents for reuse.

European Publication 529 009 describes a method of redox amplification processing using separate color development and amplification baths in which a developer-absorber is used on the amplification bath.

Published PCT specification Wo 9117478 describes a method of processing in which a developer-absorbent is using in one or more processing baths between the development and washing steps.

European Publication 566 181 describes a method of processing in which a developer-absorbent is used in a wash water or stabilizer solution bath.

All of the above processes are conventional in that the order of the tail-end baths is bleach then fix or bleach combined with fix (bleach-fix).

In a method of processing an imagewise exposed photographic silver halide color material comprising a color development, fix and bleach step in which the fix step takes places after the color development and before the bleach step as described in our as yet unpublished copending British application number 9516578.3, the problem is to have the lowest possible replenishment rates without incurring oxidized developing agent stain in the processed material. The problem does not occur if the bleaching agent is not sufficiently strong to oxidize the color developing agent. An example of such a bleaching agent is a ferric ethylenediaminetetraacetic acid.

SUMMARY OF THE INVENTION

According to the present invention there is provided a method of processing an imagewise exposed photographic silver halide color material comprising the following steps in order:

A) color developing the material with a color developer solution containing a color developing agent, B) treating the material with a treatment solution that is either a fixing or a stop solution, and C) bleaching the material with a bleaching solution, wherein each of the color developer, treatment and bleaching solutions is replenished with individual replenishing solutions, and optionally recirculated using individual recirculation lines, and wherein an absorbent material that absorbs color developing agent is present in a processing solution used between steps A and C, or in the replenishing solution or recirculation line of the processing solution used between steps A and C.

The process may be operated at low replenishment rates without the processed material showing oxidized developer stain.

DETAILED DESCRIPTION OF THE INVENTION

In one embodiment of the present invention the color developer solution contains as an oxidant, hydrogen peroxide or a compound that yields hydrogen peroxide and is therefore a developer/amplifier solution.

Examples of suitable oxidants include hydrogen peroxide and compounds which provide hydrogen peroxide, e.g., addition compounds of hydrogen peroxide or persulfates.

In a particularly useful embodiment, the processed material has substantially all silver chloride in an emulsion (e.g., at least 80% silver chloride), such as color paper or film. The process comprises color development, (or developer-amplifier), fixing then bleaching, optionally followed by a further fixing. "Developer" as used herein includes developer/amplifiers.

The fixing agent may be an alkali metal thiosulfate, thiocyanate or sulfite solution. If the bleach contains peroxide as the bleaching agent it preferably follows a sulfite fixer as thiosulfate or thiocyanate tends to inhibit the action of a peroxide bleach whereas if the fixing agent is a thiosulfate or thiocyanate fixing agent the bleaching agent preferably has a high oxidation potential, for example a ferricyanide or dichromate. Thiocyanate should, however, not be used in the present process for safety reasons as cyanide ions can be formed in an oxidizing solution, e.g., a bleach solution.

With a fresh process or one in which all solutions are replenished at rates >250 ml/m$^2$ the Dmins of all layers are low. However with a process with reduced replenishment rates, e.g., below 250 ml/m$^2$ for each solution, especially below 100 ml/m$^2$, color developing agent builds up in the fixing solution and is eventually carried into the bleaching solution where it reacts non-imagewise to give stain.

The color developing agent adsorbent may be one or more of a number of the materials: activated carbon, ion-exchange resins, e.g., cationic, anionic and mixed bed or neutral polymeric resin beads. Carbon is preferred as it is cheap and has a good capacity but using a resin might allow the developer to be recovered and reused.

While many adsorbents are known to the art, examples of useful adsorbents include:

Norit RO 0.8 (activated carbon pellets), Darco 20–40 mesh(activated carbon pellets), Darco <100 mesh(activated carbon pellets), Amberlite IRA-420(Cl) (anionic resin), Amberlite IRC-50(H) (cationic resin), Amberlite XAD-4 (neutral polymer resin), Amberlite XAD-2 (neutral polymer resin), Duolite MB 6113 (mixed bed resin), and Amberlite IRA 458 (anionic resin).

The sulfite fixing solution may contain from 20 to 150 g/l of the alkali metal sulfite (as sodium sulfite). Corresponding levels of materials that provide sulfite during processing, e.g., an alkali metal metabisulfite, can also be used. The fixer may have a pH above 6.4, preferably in the range 6.5 to 9, especially 7.0. A buffering material may be used, for example an alkali metal acetate in order to maintain the desired pH.

If desired, a second fixing step may be introduced after the bleaching step. It may be either a sulfite or thiosulfate fixing solution as the peroxide bleaching solution does not need to work after the second fixing solution.

The bleaching solution may contain 10 to 200 g/l, preferably 30 to 100 g/l of 30% w/w hydrogen peroxide solution.

The bleaching solution may also contain 0.5 to 30 g/l of alkali metal halide (as sodium chloride).

A ferricyanide bleaching solution may contain amounts of potassium ferricyanide from 2 to 150 g/l, preferably from 5 to 100 g/l and, especially, from 20 to 80 g/l.

A dichromate bleaching solution may contain amounts of potassium dichromate from 1 to 20 g/l, preferably from 2 to 15 g/l and, especially, from 5 to 10 g/l.

A peroxide bleaching solution may also contain metal-chelating agents to which metals might otherwise catalyze the decomposition of the hydrogen peroxide. Such compounds may be of the 1-hydroxyethylidene-1,1-diphosphonic acid and/or diethyltriaminepentaacetic acid type.

A peroxide bleaching solution preferably has a pH in the range 8 to 11 and is preferably about 10. It may contain a buffer, for example an alkali metal carbonate.

The total processing time is preferably from 30 to 600 seconds, especially from 45 to 250 seconds.

The processed photographic materials can be single color elements or multicolor elements having a paper or a transparent film base. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

Materials suitable for redox amplification processing will contain low amounts of silver. The total silver coating weight may be in the range 10–150 mg/m$^2$, preferably 30–100 mg/m$^2$ and particularly 40–90 mg/m$^2$.

In an alternative embodiment in the case of low silver coating weight materials where residual silver salt is acceptable, the fixing solution may be dispensed with and an acid stop solution may be used in its place. A 2–5.% solution of glacial acetic acid can be used for such a stop solution.

Suitable materials for use in this invention, can have any of the components described in *Research Disclosure* Item 36544, September 1994, published by Kenneth Mason Publications, Emsworth, Hants P010 7DQ, United Kingdom.

The present processing method is preferably carried out by passing the material to be processed through a tank containing the processing solution that is recirculated through the tank at a rate of from 0.1 to 10 tank volumes per minute.

The preferred recirculation rate is from 0.5 to 8, especially from 1 to 5 and in particular from 2 to 4 tank volumes per minute.

The recirculation, with or without replenishment, is carried out continuously or intermittently. In one method of working, both could be carried out continuously while processing was in progress but not at all or intermittently when the machine was idle. Replenishment may be carried out by introducing the required amount of replenisher into the recirculation stream either inside or outside the processing tank.

It is advantageous to use a tank of relatively small volume. Hence in a preferred embodiment of the present invention the ratio of tank volume to maximum area of material accommodatable therein (i.e., maximum path length×width of material) is less than 11 dm$^3$/m$^2$, preferably less than 3 dm$^3$/m$^2$.

The shape and dimensions of the processing tank are preferably such that it holds the minimum amount of processing solution while still obtaining the required results. The tank is preferably one with fixed sides, the material being advanced therethrough by drive rollers. Preferably the photographic material passes through a thickness of solution less than 11 mm, preferably less than 5 mm and especially about 2 mm. The shape of the tank is not critical but it could be in the shape of a shallow tray or, preferably U-shaped. It is preferred that the dimensions of the tank be chosen so that the width of the tank is the same or only just wider than the width of the material to be processed.

The total volume of the processing solution within the processing channel and recirculation system is relatively smaller as compared to prior art processors. In particular, the total amount of processing solution in the entire processing system for a particular module is such that the total volume in the processing channel is at least 40 percent of the total volume of processing solution in the system. Preferably, the volume of the processing channel is at least about 50 percent of the total volume of the processing solution in the system.

In order to provide efficient flow of the processing solution through the opening or nozzles into the processing channel, it is desirable that the nozzles/opening that deliver the processing solution to the processing channel have a configuration in accordance with the following relationship:

$$0.6<F/A<23$$

wherein:

F is the flow rate of the solution through the nozzle in liters/minute; and

A is the cross-sectional area of the nozzle provided in square centimeters.

Providing a nozzle in accordance with the foregoing relationship assures appropriate discharge of the processing solution against the photosensitive material. Such Low Volume Thin Tank systems are described in more detail in the following patent specifications: U.S. Pat. Nos. 5,294,956, 5,179,404, 5,270,762, EP-A-559,025, EP-A-559,026, EP-A-559,027, WO 92/10790, WO 92/17819, WO 93/04404, WO 92/17370, WO 91/19226, WO 91/12567, WO 92/07302, WO 93/00612, WO 92/07301, and WO 92/09932 and U.S. Pat. No. 5,436,118.

The following Example is included for a better understanding of the invention.

EXAMPLE 1

The photographic material used in this example was a color paper with a total silver laydown of 65 mg/m$^2$. It was exposed through a 0.15 log wedge with correction filters added to try to get a neutral gray scale.

The following solutions were made up:

Developer amplifier

| | |
|---|---|
| 1-hydroxyethylidene-1,1'-diphosphonic acid | 0.6 g |
| diethylenetriaminepentaacetic acid | 2.0 g |
| Dipotassium hydrogen phosphate.$3H_2O$ | 40.0 g |
| Hydroxylamine sulfate | 0.5 g |
| 4-N-ethyl-N-(b-methanesulfonamidoethyl) -o-toluidine sesquisulfate | 4.5 g |
| Water to | 1 liter |
| pH adjusted to 11.7 with sodium hydroxide | |

20 ml 3% w/w hydrogen peroxide was added just before use

| | |
|---|---|
| Sulfite Fixer | |
| Sodium sulfite (anhydrous) | 50.0 g |
| Sodium acetate | 40.0 g |
| Water to | 1 liter |
| pH adjusted to 7.0 with sulfuric acid | |
| Bleach 1 | |
| 1-hydroxyethylidene-1,1'-diphosphonic acid | 0.6 g |
| diethylenetriaminepentaacetic acid | 2.0 g |
| Sodium chloride | 1.0 g |
| Sodium hydrogen carbonate | 20.0 g |
| Hydrogen peroxide (30% w/w) | 50.0 g |
| Water to | 1 liter |
| pH adjusted to 10.0 with sodium hydroxide or sulfuric acid | |
| Bleach-fix | |
| Ammonium iron (III) EDTA solution (1.56M) | 50 ml |
| Ammonium thiosulfate | 50 g |
| Sodium sulfite | 20 g |
| Acetic acid (glacial) | 15 ml |
| Water to | 1 liter |
| pH adjusted to 6.0 | |

Process 1 was a control process carried out with fresh solutions

| Process 1 | |
|---|---|
| Developer amplifier | 45 sec |
| Stop | 45 sec |
| Bleach- fix | 45 sec |
| Wash in running water | 60 sec |
| Dry | |

Process 2 is also a control process carried out with fresh solutions

| Process 2 | |
|---|---|
| Developer amplifier | 45 sec |
| Sulfite fixer | 45 sec |
| Bleach 1 (pH of 7 to 11) | 45 sec |
| Wash in running water | 60 sec |
| Dry | |

Process 3 was a repeat of Process 2 after artificially seasoning the sulfite fixing solution and peroxide bleaching solution as if the carry over rates from one bath to the next were 30 ml/m$^2$ and the replenishment rates were 50 ml/m$^2$. This was done by taking 3 parts developer and 5 parts fixing solution and mixing to make the seasoned fixing solution. To make the seasoned bleaching solution, 3 parts of the seasoned fixing solution were mixed with 5 parts bleaching solution.

Process 3 was repeated but treating samples of the seasoned fixing solution with different adsorbents as listed in Table 1 in the following manner. 800 ml of the fixing solution were stirred on a magnetic stirrer with 20 g of the chosen adsorbent for 10 mins. The mixture was then filtered and the treated fixing solution was used to process the paper as in Process 3.

Table 1 shows the stains of the three color records for the different processes

TABLE 1

| Process | Absorbent | Red Dmin | Green Dmin | Blue Dmin | Comment |
|---|---|---|---|---|---|
| 1 | None | 0.110 | 0.115 | 0.115 | Comparison |
| 2 | None | 0.109 | 0.113 | 0.095 | Comparison |
| 3 | None | 0.183 | 0.182 | 0.204 | Comparison |
| 3 | Norit RO 0.8 (activated carbon pellets) | 0.109 | 0.114 | 0.093 | Invention |
| 3 | Darco 20–40 mesh (activated carbon pellets) | 0.110 | 0.114 | 0.092 | Invention |
| 3 | Darco <100 mesh (activated carbon pellets) | 0.132 | 0.142 | 0.120 | Invention |
| 3 | Amberlite IRA-420(Cl) (anionic resin) | 0.110 | 0.119 | 0.099 | Invention |
| 3 | Amberlite IRC-50(H) (cationic resin) | 0.139 | 0.140 | 0.123 | Invention |
| 3 | Amberlite XAD-4 (neutral polymer resin) | 0.128 | 0.131 | 0.108 | Invention |
| 3 | Amberlite XAD-2 (neutral polymer resin) | 0.148 | 0.145 | 0.126 | Invention |
| 3 | Duolite MB 6113 (mixed bed resin) | 0.132 | 0.135 | 0.113 | Invention |
| 3 | Amberlite IRA 458 (anionic resin) | 0.142 | 0.142 | 0.120 | Invention |

The results in Table 1 show that all the resins and carbons are capable of reducing the stain (Dmin) in the paper caused by seasoning, carbon and the anionic resins being the most effective.

EXAMPLE 2

The photographic material used in this example was a conventional color paper, KODAK 'Supra', containing a pyrazolone magenta coupler, with a total silver laydown of about 650 mg/m$^2$. The silver halide is essentially all silver chloride. This material was exposed in a sensitometer at 1/10 sec through a 0.15 log wedge with correction filters added to try to get a neutral gray scale. The wedge also includes red, green and blue separations.

The following solutions were made up to be used in the processes that follow:

| | |
|---|---|
| Developer | |
| 1-hydroxyethylidene-1,1'-diphosphonic acid | 0.6 g |
| Diethylenetriaminepentaacetic acid | 2.0 g |
| Triethanolamine | 5.5 ml |
| Diethylhydroxylamine | 5 ml |
| Phorwite REU | 1 g |
| Potassium chloride | 6.4 g |
| Potassium carbonate | 25 g |
| 4-N-ethyl-N-(b-methanesulfonamidoethyl) -o-toluidine sesquisulfate | 4.5 g |
| Water to | 1 liter |
| pH adjusted to 10.3 with sodium hydroxide | |
| Sulfite Fixer | |
| Sodium sulfite (anhydrous) | 100.0 g |
| Sodium acetate | 40.0 g |

-continued

| | |
|---|---|
| Water to | 1 liter |
| pH adjusted to 7.0 with sulfuric acid | |
| Bleach 2 | |
| 1-hydroxyethylidene-1,1'-diphosphonic acid | 1.0 g |
| Sodium chloride | 20.0 g |
| Sodium hydrogen carbonate | 3.0 g |
| Sodium carbonate | 4.0 g |
| Hydrogen peroxide (30%) | 50.0 g |
| Water to | 1 liter |
| pH adjusted to 10.0 with sodium hydroxide or sulfuric acid | |
| Bleach-fix | |
| Ammonium iron (III) EDTA solution (1.56M) | 100 ml |
| Ammonium thiosulfate | 100 g |
| Sodium sulfite | 20 g |
| Acetic acid (glacial) | 15 ml |
| Water to | 1 liter |
| pH adjusted to 6.0 | |

The following is a list of processes used to test the invention. Each process is either to be used as a comparison or as example of the invention.

Process 4 was the conventional process

| Process 4 | |
|---|---|
| Developer amplifier | 45 sec |
| Bleach-fix | 45 sec |
| Wash | 60 sec |
| Dry | |

Process 5 was a peroxide bleach process used fresh

| Process 5 | |
|---|---|
| Developer amplifier | 45 sec |
| Sulfite fixer | 90 sec |
| Bleach 2 | 90 sec |
| Sulfite fixer | 90 sec |
| Wash | 60 sec |
| Dry | |

Process 6 was an artificially seasoned version of Process 5, seasoned in the same way as Process 3 was made from Process 2.

Process 6 was repeated but treating samples of the seasoned fixer with different adsorbents as listed in Table 1 in the following manner: 800 ml of the fixer were stirred on a magnetic stirrer with 20 g of the chosen adsorbent for 10 mins. The mixture was then filtered and the treated fixer was used to process the paper as in Process 6.

Table 2 summarizes the results of the stains from the different processes

TABLE 2

| Process | Absorbent | Red Dmin | Green Dmin | Blue Dmin | Comment |
|---|---|---|---|---|---|
| 4 | None | 0.096 | 0.104 | 0.119 | Comparison |
| 5 | None | 0.099 | 0.103 | 0.115 | Comparison |
| 6 | None | 0.193 | 0.194 | 0.201 | Comparison |
| 6 | Norit RO 0.8 (activated carbon pellets) | 0.099 | 0.103 | 0.113 | Invention |

TABLE 2-continued

| Process | Absorbent | Red Dmin | Green Dmin | Blue Dmin | Comment |
|---|---|---|---|---|---|
| 6 | Darco 20–40 mesh (activated carbon pellets) | 0.096 | 0.104 | 0.122 | Invention |
| 6 | Amberlite IRA-420(Cl) (anionic resin) | 0.100 | 0.109 | 0.099 | Invention |

It is seen from Table 2 that the carbon and the ion-exchange resin are capable of removing the stain in this conventional paper.

EXAMPLE 3

Example 2 was repeated using a paper with conventional silver laydown containing a pyrazolotriazole coupler (Fuji SFA-3). The results are show in Table 3.

TABLE 3

| Process | Absorbent | Red Dmin | Green Dmin | Blue Dmin | Comment |
|---|---|---|---|---|---|
| 1 | None | 0.105 | 0.109 | 0.115 | Comparison |
| 2 | None | 0.106 | 0.113 | 0.114 | Comparison |
| 3 | None | 0.183 | 0.182 | 0.195 | Comparison |
| 3 | Norit RO 0.8 (activated carbon pellets) | 0.109 | 0.104 | 0.113 | Invention |

The results in Table 3 show that the stain is also reduced in papers containing a pyrazolotriazole magenta coupler.

EXAMPLE 4

Example 2 was repeated with Bleach 2 replaced with a dichromate bleach and the fix being a thiosulfate fixer, the composition of which solutions follow:

| | |
|---|---|
| Dichromate bleach | |
| Potassium dichromate | 10.0 g |
| Sodium chloride | 10.0 g |
| Sulfuric acid (concentrated) | 10 ml |
| Water to | 1 liter |
| Thiosulfate Fixer | |
| Ammonium thiosulfate | 100 g |
| Sodium sulfite | 10 g |
| Acetic acid | 10 ml |
| Water to | 1 liter |
| pH adjusted to 5.0 | |

The results are shown in Table 4

TABLE 4

| Process | Absorbent | Red Dmin | Green Dmin | Blue Dmin | Comment |
|---|---|---|---|---|---|
| 4 | None | 0.096 | 0.104 | 0.119 | Comparison |
| 5* | None | 0.097 | 0.107 | 0.120 | Comparison |
| 6* | None | 0.193 | 0.201 | 0.222 | Comparison |
| 6* | Norit RO 0.8 (activated carbon pellets) | 0.099 | 0.105 | 0.116 | Invention |
| 6* | Darco 20–40 mesh (activated carbon pellets) | 0.097 | 0.104 | 0.117 | Invention |
| 6* | Amberlite IRA-420(Cl) (anionic resin) | 0.100 | 0.103 | 0.115 | Invention |

*with dichromate bleach

The results tabulated in Table 4 show that the adsorbents are effective at reducing stain using a dichromate bleach, the dichromate bleach having sufficient oxidizing potential to oxidize color developer.

The invention has been described in detail with particular reference to preferred embodiments thereof, but it will be understood that variations and modifications can be effected within the spirit and scope of the invention.

I claim:

1. A method of processing an imagewise exposed photographic silver halide color material comprising an emulsion having at least 80 mol % silver chloride, said method comprising the following steps in order:

A) color developing said material with a color developer solution containing a color developing agent, B) treating said material with a treatment solution that is either a fixing or a stop solution, said fixing solution containing an alkali metal sulfite as a fixing agent, and C) bleaching said material with a bleaching solution that contains hydrogen peroxide or a compound that provides hydrogen peroxide as the bleaching agent, wherein each of said color developer, treatment and bleaching solutions is replenished with individual replenishing solutions at a replenishment rate of less than 250 $ml/m^2$, with or without recirculation using individual recirculation lines, and wherein an absorbent material that absorbs color developing agent is present in a processing solution used between steps A and C, or in the replenishing solution or recirculation line of said processing solution used between steps A and C.

2. The method of claim 1 wherein said color developer solution contains hydrogen peroxide or a compound that provides hydrogen peroxide.

3. The method of claim 1 wherein said absorbent material is activated carbon or an ion-exchange resin.

4. The method of claim 3 wherein said ion-exchange resin is an anionic resin.

5. The method of claim 1 wherein the total silver coating weight of said material processed is in the range from 10 to 150 $mg/m^2$.

6. The method of claim 1 wherein said treatment solution is a stop solution.

7. The method of claim 1 wherein said material is washed with a wash solution between steps A and C.

8. The method of claim 7 wherein said absorbent material is in said wash solution, or in a replenishment solution therefor, or in the recirculation line therefor.

* * * * *